United States Patent [19]

Belcher

[11] 4,245,208

[45] Jan. 13, 1981

[54] ELECTRIC FUSE HAVING OFF CENTER FUSIBLE ELEMENT

[75] Inventor: Richard A. Belcher, Hampton Falls, N.H.

[73] Assignee: Gould Inc., Rolling Meadows, Ill.

[21] Appl. No.: 75,623

[22] Filed: Sep. 14, 1979

[51] Int. Cl.[3] ..... H01H 85/16

[52] U.S. Cl. ..... 337/231; 337/252

[58] Field of Search ..... 337/158, 159, 229, 231, 337/248, 251, 252, 254

[56] References Cited

U.S. PATENT DOCUMENTS

| | | | |
|---|---|---|---|
| 3,413,585 | 11/1968 | Kozacka | 337/158 X |
| 3,849,754 | 11/1974 | Blewitt et al. | 337/231 |

*Primary Examiner*—George Harris
*Attorney, Agent, or Firm*—Erwin Salzer

[57] ABSTRACT

An electric fuse the fusible element of which is arranged off-center of the casing. The fuse casing is closed by caps through the end surfaces of which the knife blade contacts project into the casing. The spacing of the end surfaces of the caps to the axially inner ends of the blade contacts is substantially equal. Each of the axially inner ends of the blade contacts is conductively connected to the fusible element by the intermediary of a flexible metal strip having a smaller cross-section than each of the blade contacts. This imparts a relatively great flexibility to the unit including the blade contacts, the flexible metal strips and the fusible element.

4 Claims, 6 Drawing Figures

ELECTRIC FUSE HAVING OFF CENTER FUSIBLE ELEMENT

BACKGROUND OF THE INVENTION

This invention relates to an improvement of the fuses disclosed in U.S. Pat. No. 3,413,585; 11/26/68 to Frederick J. Kozacka for ELECTRIC CARTRIDGE FUSE HAVING OFF CENTER FUSIBLE ELEMENTS. That patent solves the problem of increasing the ratio of axial to radial heat flow in a fuse having a relatively long casing and a relatively short fusible element by arranging the fusible element off-center, i.e. relatively close to one of the caps of the fuse. This increases the axial heat flow to the cap or terminal closest to the fusible element and by so doing limits the temperature prevailing near the center of the casing of the fuse.

In U.S. Pat. No. 3,413,585 the fusible elements is directly connected to the knife blade contacts, e.g. by spot welding. This results in a relatively unflexible structure. The contrary of that is required, i.e. a relatively flexible structure, because the relatively thin and fragile fusible element is readily deformed by external forces, e.g. by torsional forces, transmitted to it by movements of the knife blade contact relative to the fusible element.

It is therefore, one object of the invention to provide fuses of the above kind, i.e. having off-center fusible elements, that increase the ratio of axial to radial heat flow and thus limit the peak temperature in the region of the center of the casing, or limit the temperature prevailing at this point.

Fuses having knife blade contacts that project from the outside of the casing through the ends surfaces of the terminal caps to the ends of an off-center fusible element, or to the ends of a plurality of off-center fusible elements, require a relatively large amount of blade contact material, i.e. of copper. It is another object of this invention to reduce the amount of blade contact material without any significant increase of the voltage drop across the fuse.

These and other objects of the invention will become more apparent as the present specification proceeds.

SUMMARY OF THE INVENTION

This invention refers to electric low-voltage fuses including a tubular casing of electric insulating material having a predetermined length, and a fusible element whose length is considerably less than said predetermined length of said casing, arranged off-center of said casing and spaced a smaller distance from one of the ends of said casing than from the opposite end thereof. The ends of the casing of the fuses are closed by a pair of terminal caps, and a pair of knife blade contacts projects through the end surfaces of said pair of terminal caps. A pulverulent arc-quenching filler arranged inside said casing embeds the fusible element.

The novel features which characterize this invention consist in that the length of said pair of knife blade contacts that project from said end surfaces of said pair of caps is approximately equal for both said pair of knife blade contacts and leaves a pair of gaps of unequal length between said axially inner ends of said pair of knife blade contacts and said fusible element and in that each of a pair of flexible strips extends across one of said pair of gaps connecting the axially outer ends of said fusible element with the axially inner ends of said pair of knife blade contacts, said pair of flexible metal strips having a cross-sectional area substantially less than the cross-sectional area of each of said pair of knife blade contacts.

DESCRIPTION OF PREFERRED EMBODIMENTS

Figure 1:
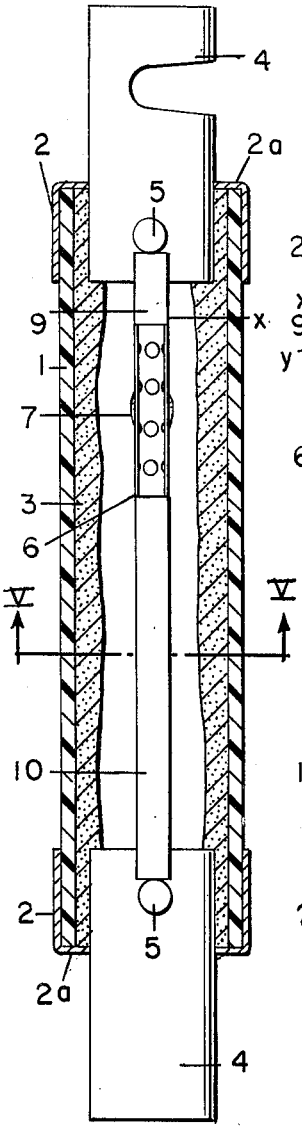
FIG. 1 is substantially a longitudinal section of a fuse embodying the present invention showing some parts in elevation rather than sectionalized.
Figure 2:
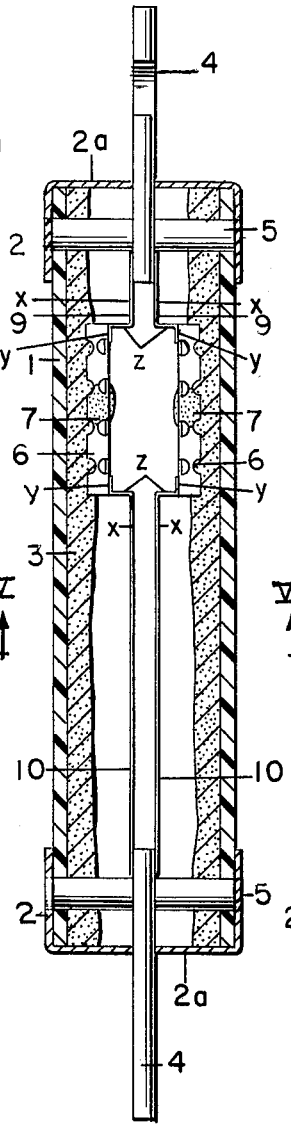
FIG. 2 is substantially a section taken at an angle of 90 degrees to the plane of FIG. 1 showing some parts in elevation rather than sectionalized.
Figure 5:
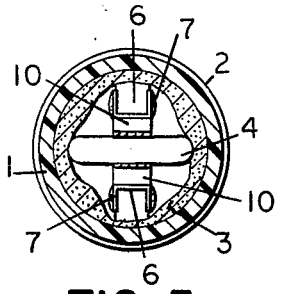
FIG. 5 is a section along V—V of FIG. 1.

Referring now to the drawings, and more particularly to FIGS. 1, 2 and 5 thereof, numeral 1 has been applied to indicate a casing of electric insulating material closed by a pair of terminal caps 2 and filled with a granular arc-quenching filler 3, e.g. quartz sand. Blade contacts 4 project from the outside of the casing through the end surfaces 2*a* of caps 2 into the inside of the casing 1. The length of the ends of blade contacts 4 which project from end surfaces 2*a* into the inside of casing 1 are substantially equal. Blade contacts 4 are supported by pins 5 which project through the wall of casing 1. Reference numeral 6 has been applied to indicate a pair of perforated channel-shaped fusible elements of which each is covered by an M-effect causing overlay 7. The length of fusible elements 6 is much less than the length of casing 1. The upper ends of fusible elements 6 are conductively connected to upper blade contact 4 by the intermediary of a pair of thin flexible metal strips 9 having a small resistivity, e.g. copper. The lower end of fusible elements 6 are conductively connected to the lower knife blade contact 4 by a pair of thin flexible metal strips 10 having a small resistivity, e.g. copper. The total cross-section of strips 9 and 10 is less than the cross-section of blade contacts 4. The cross-section of blade contacts 4 must be larger than the cross-section of strips 9 and 10 because the cross-section of strips 9 and 10 is determined by voltage drop considerations, and that of blade contacts 4 by mechanical considerations. Thus the present invention allows to use much lighter and much less metal consuming leads 9,10 than the long blade contacts of U.S. Pat. No. 3,413,585. The main purpose of strips 9 and 10 is, however, not metal economy, but to impart an increased flexibility to the current-carrying units 4,9,6,10,4. In the structure shown in U.S. Pat. No. 3,413,585 the fusible element may have very little mechanical stability because it is generally made of thin sheet silver, and generally weakened by numerous perforations and the heavy blade contacts are directly affixed to it. Forces exerted upon the blade contacts are directly transmitted to the fragile fusible element and tend to damage the latter. This limitation of U.S. Pat. No. 3,413,585 is completely avoided by the present invention. The space taken in the structure of U.S. Pat. No. 3,413,585 by its knife blade contacts is largely taken in the present structure by the flexible coupling strips 9 and 10. The spacing of the axially inner ends of blade contacts 4 from the end surfaces *2a* of caps 2 is substantially of equal length in a fuse according to the present invention. In the embodiment of the invention shown in FIGS. 1 and 2 each metal strip 9 and 10 has a first portion x arranged parallel to the plane defined by the pair of knife blade contacts 4, and arranged in spaced relation from the fusible element 6, a second portion y conductively bonded to said fusible element 6, and an intermediate portion z at right angles to said portion x and said second portion y.

Figure 3:
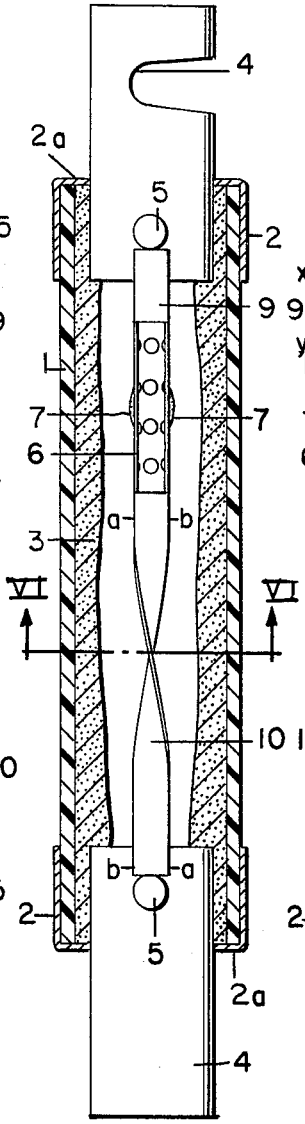
FIG. 3 is substantially a longitudinal section of another fuse embodying the present invention showing some parts in elevation rather than sectionalized.
Figure 4:
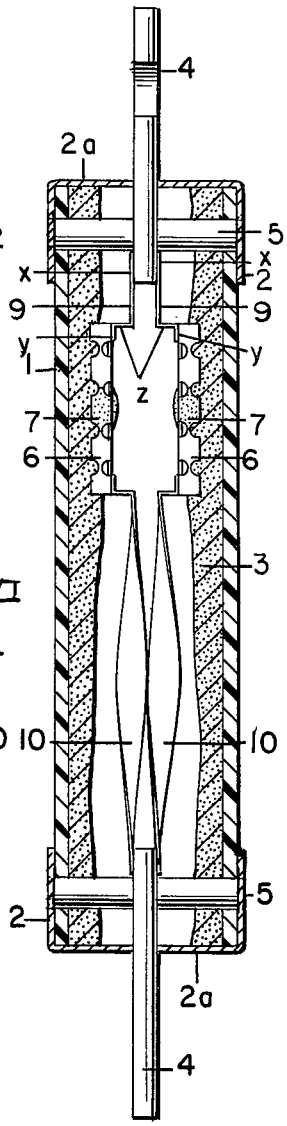
FIG. 4 is substantially a section taken at an angle of 90 degrees to the plane of FIG. 3 showing some parts in elevation rather than sectionalized.
Figure 6:
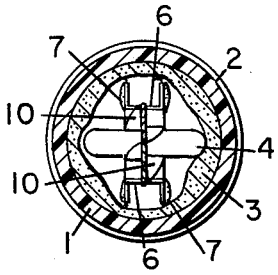
FIG. 6 is a section along VI—VI of FIG. 3.

In FIGS. 3, 4 and 6 the same reference characters as in FIGS. 1, 2 and 5 have been applied to indicate like parts. Hence FIGS. 3, 4 and 6 are self-explanatory to the extent that the structure shown therein is the same as that shown in FIGS. 1, 2 and 5. The structure of FIGS. 3, 4 and 6 differs from that of FIGS. 1, 2 and 5 by the way lower knife blade contact 4 is conductively bonded, or connected, with the fusible element 6. One end of fusible element 6 is conductively connected to flexible metal strip 10 on one end thereof, strip 10 is twisted about 180 degrees in the intermediate portion between both ends thereof, and conductively bonded with the side thereof opposite to said one side to one of said pair of knife blade contacts. The twisting of parts 10 is clearly apparent from FIGS. 3, 4 and 6.

Considering FIG. 3, the edge a of flexible metal strip 10 is at the left where strip 10 is affixed to fusible element 6, but edge a is at the right where strip 10 is affixed to lower blade contact 4. Similarly, the edge b of flexible metal strip 10 is at the right where affixed to fusible element 6, but at the left where affixed to the lower blade contact 4.

In all figures a pair of fusible elements 6 has been shown in each fuse rather than but one fusible element and each of both fusible elements 6 is conductively connected by like flexible means 10 to lower blade contact 4.

I claim as my invention:

1. An electric low-voltage fuse including a tubular casing of electric insulating material having a predetermined length, a fusible element whose length is considerably less than said predetermined length of said casing, arranged off-center of said casing and spaced a considerably smaller distance from one of the ends of said casing than from the opposite end thereof, a pair of terminal caps closing the ends of said casing, a pair of knife blade contacts projecting through the end surfaces of said pair of terminal caps, and a pulverulent arc-quenching filler inside said casing, wherein the novel features consist in that (a) the length of the axially inner ends of said pair of knife blade contacts that project from the end surfaces of said pair of caps into said casing is approximately equal for both said pair of knife blade contacts and leaves a pair of gaps of unequal length between said axially inner ends of said pair of knife blade contacts and said fusible element; and in that (b) each of a pair of flexible metal strips extends across one of said pair of gaps conductively connecting the axially outer ends of said fusible element with the axially inner ends of said pair of knife blade contacts, said pair of flexible metal strips having a cross-sectional area substantially less than the cross-sectional area of each of said pair of knife blade contacts.

2. An electric low-voltage fuse as specified in claim 1 wherein each of said pair of flexible strips includes a first portion arranged parallel to the plane defined by said pair of blade contacts and arranged in spaced relation from said fusible element, a second portion conductively bonded to said fusible element, and an intermediate portion bent at right angles to said first portion and to said second portion.

3. An electric low-voltage fuse as specified in claim 1 wherein the longer of said pair of flexible metal strips is twisted about 180 degrees between the point of connection to said fusible element and the point of connection to one of said pair of knife blade contacts so that the left edges and the right edges of said flexible metal strip are inverted at the point of connection to said fusible element and at the point of connection to one of said pair of knife blade contacts.

4. An electric low-voltage fuse as specified in claim 1 wherein the axially inner end of one of said pair of knife blade contacts is conductively connected to one of the ends of said fusible element by the intermediary of a first metal strip including a first portion arranged parallel to the plane defined by said pair of knife blade contacts and arranged in spaced relation from said fusible element, a second portion parallel to said first portion and conductively bonded to said fusible element, and said first metal strip further including an intermediate portion bent at right angles to said first portion and said second portion thereof, and wherein the axially inner end of the other of said pair of knife blade contacts is conductively connected to the other of said ends of said fusible element by the intermediary of a second metal strip twisted in such a way that the edge of said second strip situated to the left of said fusible element is transposed to the right at the other of said pair of knife blade contacts and that the edge of said second metal strip situated at the right at said fusible element is transposed to the left at said other of said pair of knife blade contacts.

* * * * *